United States Patent [19]

Elworthy

[11] 4,380,956

[45] Apr. 26, 1983

[54] MOUNTING OF FLEXIBLE PRINTING PLATES

[75] Inventor: Graham J. Elworthy, Leighton Buzzard, England

[73] Assignee: Protocol Engineering Limited, Hertfordshire, England

[21] Appl. No.: 300,359

[22] Filed: Sep. 8, 1981

[30] Foreign Application Priority Data

Sep. 9, 1980 [GB] United Kingdom ..... 8029111

[51] Int. Cl.[3] ..... B41C 1/02; B41F 27/00

[52] U.S. Cl. ..... 101/401.1; 101/383

[58] Field of Search ..... 101/401.1, 415.1, 382 R, 101/383, 384, 128.1, 127.1

[56] References Cited

U.S. PATENT DOCUMENTS

| | | | |
|---|---|---|---|
| 1,247,308 | 11/1917 | Meuser | 101/128.1 |
| 2,609,749 | 9/1952 | Kreglewski | 101/382 X |

FOREIGN PATENT DOCUMENTS

| | | | |
|---|---|---|---|
| 15471A1 | 9/1980 | European Pat. Off. . | |
| 2809929 | 9/1978 | Fed. Rep. of Germany | 101/128.1 |
| 122134 | 1/1919 | United Kingdom . | |
| 421823 | 12/1934 | United Kingdom . | |
| 450223 | 1/1936 | United Kingdom | 101/128.1 |
| 493257 | 10/1938 | United Kingdom . | |
| 704742 | 3/1954 | United Kingdom . | |
| 736002 | 8/1955 | United Kingdom . | |
| 1128207 | 9/1968 | United Kingdom . | |

*Primary Examiner*—E. H. Eickholt

*Attorney, Agent, or Firm*—Biebel, French & Nauman

[57] ABSTRACT

Flexible printing plates are mounted in a located in-register position on the plate cylinder of a rotary printing press or equivalent cylinder of a mounter-proofer by forming matching registration holes in the printing plates and at least one carrier sheet respectively.

16 Claims, 15 Drawing Figures

Figure 4:
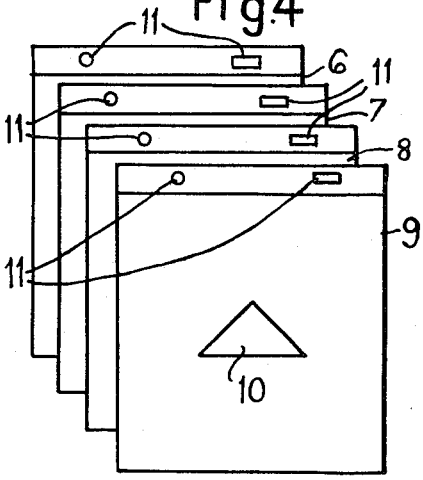

Fig.1
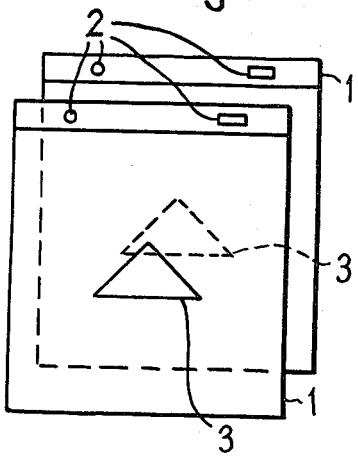
Fig.2
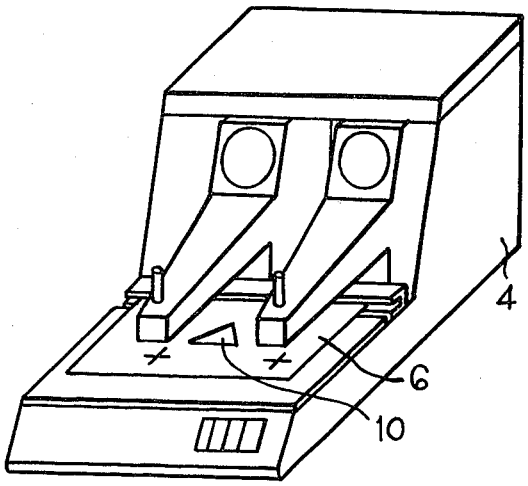
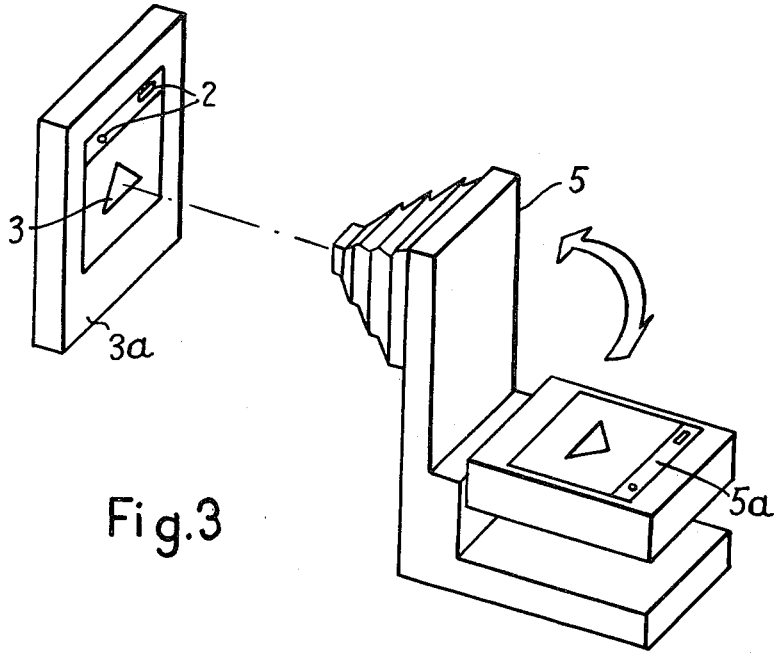
Fig.3

MOUNTING OF FLEXIBLE PRINTING PLATES

The present invention relates to the mounting of flexible printing plates on rotary printing machines and more particularly, but not exclusively to the mounting of flexo-graphic printing plates on the printing cylinders of flexo-graphic printing presses.

In flexo-graphic colour printing, the flexo-graphic printing plates are made of a soft plastics material or rubber having a photopolymeric layer carrying the image and having an adhesive backing for securing the plates to the printing cylinders. The printing plates for at least two colours are located in register on the respective plate cylinders with the aid of a mounter-proofer, which comprises an impression cylinder carrying a blank sheet of paper, a station for receiving a plate cylinder from the press in a position such that it forms a nip with the impression cylinder, and an inking mechanism. The first printing plate(s) for one colour is/are located in register on a first plate cylinder in the mounter-proofer using complicated and time-consuming measurement techniques and once in position is adhered to the cylinder. The mounter-proofer is then operated to ink the printing plate(s) and to transfer the photographic image on the printing plate(s) to the blank sheet of paper on the impression cylinder. The first plate cylinder is then removed from the mounter-proofer and replaced in the press and the second plate cylinder for a second colour is removed from the press and placed in the mounter-proofer. Then, using complicated optical techniques, an image of the printed impression on the sheet of paper on the impression cylinder is projected onto the second plate cylinder and the printing plate(s) for the second colour is/are located on the second plate cylinder using visual image-to-image registration and then adhered to the second plate cylinder. The second plate cylinder is then removed from the mounter-proofer, and the procedure is repeated for any remaining plate cylinders. The removal and replacement of plate cylinders from the printing press requires the use of heavy-duty industrial moving equipment since the plate cylinders may be as long as 90 inches and 60 inches in circumference.

Depending upon the detail of the printing plate(s) this method may take a skilled operative from two to five days. Moreover, the more detail to the printing image, the more likely are out-of-register printing innaccuracies to occur. Indeed, it has been found that registration innaccuracies can be up to 0.010 inch and in some cases even as much as 0.020 inches. Down-time for a printing press is extremely costly nowadays and so is the tying up of a skilled operative's time for such long periods, and despite all this registration innaccuracies still occur.

Accordingly, it is an object of the present invention to provide a method of mounting flexible printing plates, in particular flexo-graphic printing plates in a rotary printing press, in which none of the printing cylinders or their equivalents have to be removed from the press, and in which registration accuracy is considerably improved.

Another object of the present invention is to provide a method of mounting the printing plates in a mounter-proofer so that whilst the press is operating with one print line, another set of cylinders for another print line can have a set of colour printing plates accurately located in register thereon ready for a further printing operation, thus further reducing press down-time.

To these ends, and from one aspect, the present invention consists in a method of mounting flexible printing plates in a rotary printing press or a mounter-proofer, which method is characterised by forming matching registration holes in the flexible printing plates and in at least one carrier, by means of which the printing plates can be located in register on a press cylinder or an equivalent thereto.

By means of forming matching registration holes in the printing plates and a carrier, further matching registration holes can be formed in a mounting bar, register pins inserted in these mounting bar register holes and through register holes in the carrier and the mounting bar can then be positioned in the printing press or mounter-proofer by laying it on either the plate or impression cylinders or, alternatively, supporting it on a part of the frame of the press or mounter-proofer. Since the position of each printing plate with respect to the carrier, the position of the carrier with respect to the mounting bar and the position of the mounting bar with respect to the particular cylinder or frame part always remains the same, not only is registration accuracy considerably improved as compared to the prior art method, but the time taken to achieve location of the printing plates and fix them in position on the plate cylinders can be reduced to as little as half a day.

As an alternative to using mounting bars, registration holes may be drilled in either of the plate or impression cylinders and register pins fixed in these holes.

In what is known in the art as a belt rotary press, an endless flexible plastics belt replaces the conventional plate cylinder and in such presses, the plastics belt forms the carrier in which registration holes are formed. In such cases, a mounting bar or drilled holes in the impression cylinder is not required. Thus, the invention also comprehends the mounting of flexible printing plates in such presses.

In a preferred embodiment of the invention, which involves the use of flexo-graphic printing plates, the register holes are drilled with a hollow drill in the soft material of the flexo-graphic printing plates using the PROTOCOL REGISTRATOR machine described in the specification of our U.S. Pat. No. 3,574,946. Applicants have found that since the material of the flexo-graphic printing plates is so soft, normal punching methods are unsuitable for forming register holes in the plates.

Once the flexible flexo-graphic printing plates have been pre-drilled, and exposed, and mounted on the carrier, which is conveniently a clear plastics sheet, for example that sold under the registered trade mark MYLAR, and the carrier sheet mounted on the mounting bar, the mounting bar is then located on the impression or plate cylinder and fixed in the located position by suitable fixing means. Alternatively, as mentioned previously, the mounting bar could be fixed to a part of the frame of the press or the mounter-proofer. The flexo-graphic printing plate or plates may be placed image down on the carrier, a light coating of a transparent adhesive having been previously applied thereto, and the carrier with the printing plate(s) thereon is fed into the nip between the impression and plate cylinders. The register pins are then removed from the carrier sheet so that the printing plate(s) is held on the carrier sheet by means of the light adhesive, the impression and plate cylinders are rotated and the printing plate(s) are adhered to the plate cylinder by means of an adhesive backing on the printing plate(s). Since the register holes occupy the same positions, and the mounting bar can be fixed in the same position for each printing cylinder/impression cylinder stage, registration accuracy is obtained.

Instead of applying a light coating of a transparent adhesive to the image side of the printing plate or plates and pinning the printing plate(s) to the carrier foil(s) image side down for later transfer to the plate cylinder using a mounting bar or pins in the cylinder the printing plate(s) are pin-located to a or their respective carrier sheets image side up and the carrier sheet(s) located to pins fitted in the plate cylinder or equivalent mounter-proofer cylinder.

It should be appreciated that the invention is not limited to flexo-graphic printing plates and to colour printing but may also be used in letter press and for black and white printing.

The invention also involves steps in a process which involves registration from art work and camera or scanner to the printing press and can therefore utilise as preliminary steps in the process, the invention described in Applicant's co-pending U.S. patent application Ser. No. 178,736 which describes the use of an optical-film punch in a method of punch registration of sets of colour films prior to the montage stage, and the invention described in the Applicant's U.S. Pat. No. 3,574,946 which describes a method of registering sets of colour separations or like films at the montage stage, prior to exposure of the films to the printing plate.

Figure 10:
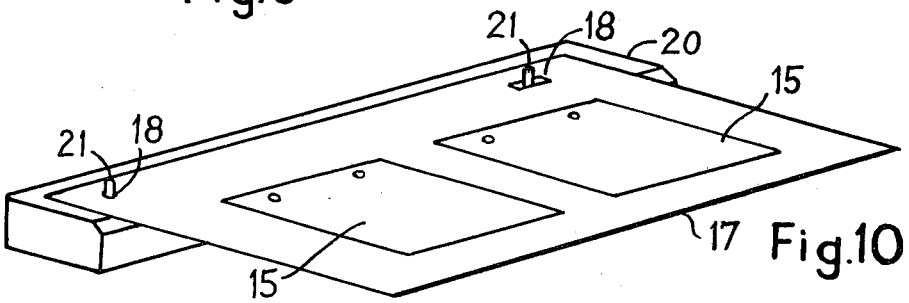
Figure 11:
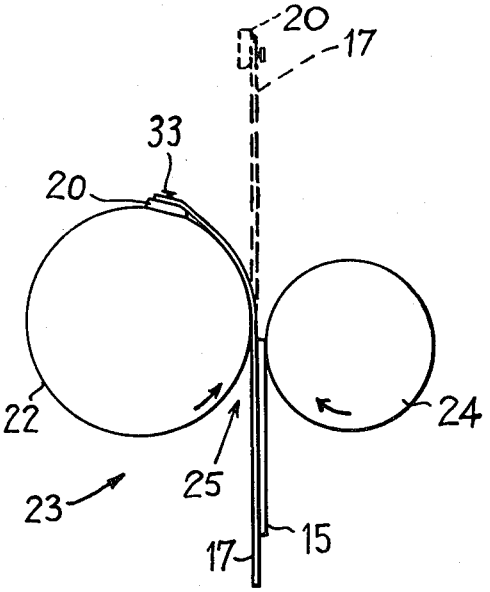
Figure 12:
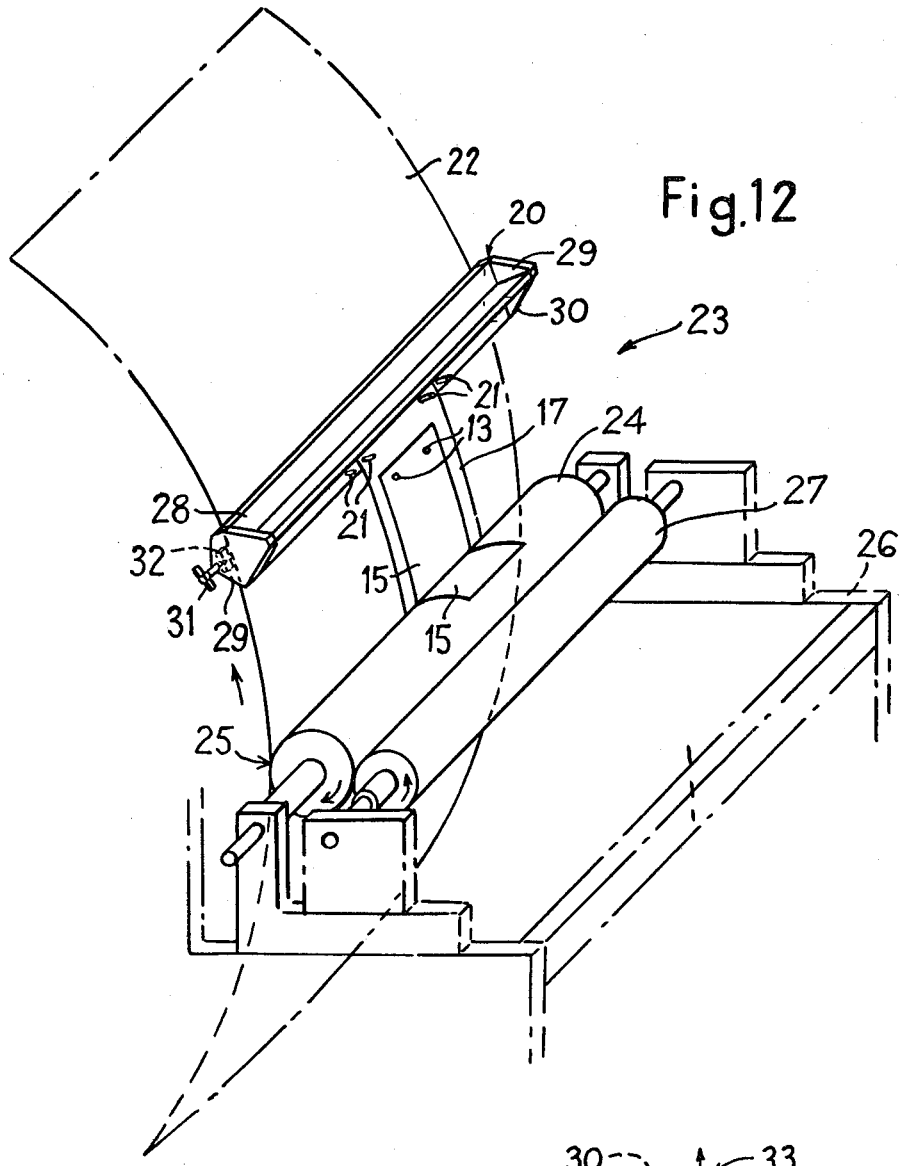
Figure 13:
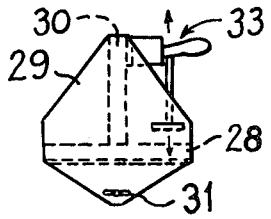
Figure 14:
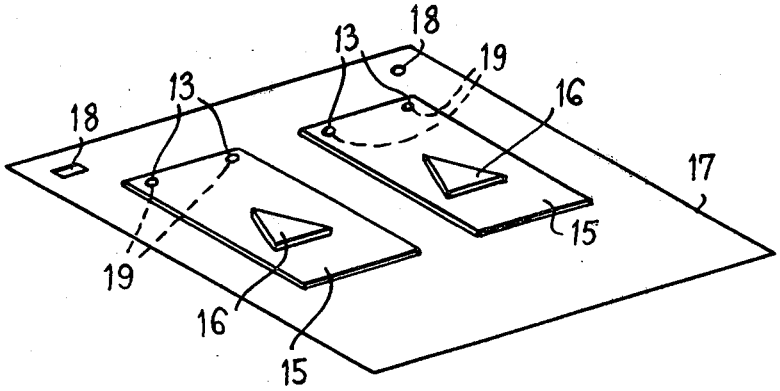
Figure 15:
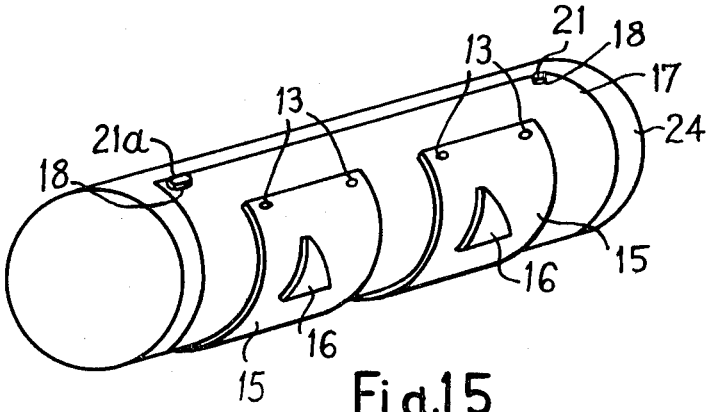

In order that the invention may be more readily understood, reference will now be made to the accompanying drawings in which:

FIGS. 1 to 11 show a sequence of obtaining registration in a multi-colour printing process from the stage of the original art work through to the printing press, using flexo-graphic printing plates and in which FIG. 3 is an alternative stage in the sequence to that of FIG. 2, FIG. 12 is a diagrammatic perspective view of a part of a flexo-graphic printing press, FIG. 13 is a detail view of one way of securing a carrier sheet carrying a printing plate to a mounting bar, and FIGS. 14 and 15 show alternative stages in the sequence to those illustrated in FIGS. 9 to 12.

Referring to the drawings, FIG. 1 shows the art work production stage at which art work and overlays 1 are punched with register holes 2 so that the image 3 is in set relationship with the register holes. The punch centre distance is selected to suit the art work size.

The art work and overlays on register pins are then fitted to a camera copy board 3*a* which produces colour separations on film or films, or fitted to a copy cylinder on an electronic scanner, which are then punch registered using the optical film punch 4 shown in FIG. 2 and described in the specification of our co-pending U.S. patent application Ser. No. 178,736. In the specification of this application, provision is made for projecting two magnified images of respective areas of film onto respective screens and the magnified images may be of register markings, on a first film which markings can then be aligned with similar markings in the region of (on or adjacent) the screens after which the first film is punched and removed, and second, third and fourth films with identically located register markings are successively placed in the punch and similarly aligned, and punched, or, the magnified images may be of portions of the image area in which case a second film is superimposed over a first film held in the punch and aligned image to image with the first film and then punched. Thus, the film areas may be constituted by register markings or by portions of the image area.

Alternatively, as shown in FIG. 3, the unexposed film 5*a* is pre-punched and registered on pins in the vacuum back of a camera 5. The procedure is then repeated to obtain two or more exposed films to make up a colour set of separations. Whichever method is used, there is obtained a set of colour separations 6 to 9, each having an image 10 thereon and punch-registered with register holes 11 with known image to hole relationship, as will be seen from FIG. 4. The hole centre distance, again, is chosen to match the particular art work.

Figure 5:
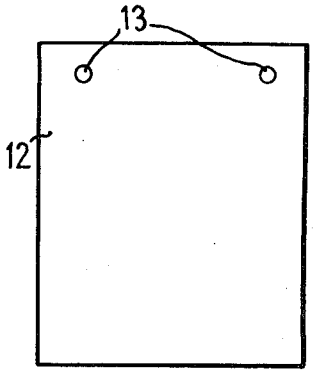
Figure 6:
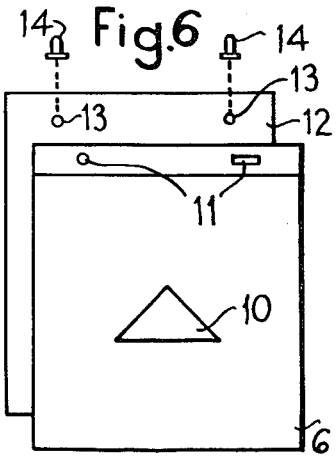

Referring now to FIG. 5, there is shown an unexposed flexo-graphic printing plate 12 which is made of a soft, flexible, plastics material and has on one face thereof a layer of a photopolymer to receive the image from one of the colour separations. A set of such printing plates 12, one per colour, are each drilled, using a hollow drill, with two round holes 13 on a PROTOCOL REGISTRATOR machine which is described in the specification of our U.S. Pat. No. 3,574,946 with a hole size and center distance to match the original film punch holes 11 on the colour separations 6 to 9. Each pre-drilled unexposed printing plate 12 and a respective punch registered colour separation 6, 7, 8 or 9 are married in turn together on register pins 14 and are placed in a vacuum frame for plate exposure.

Figure 7:
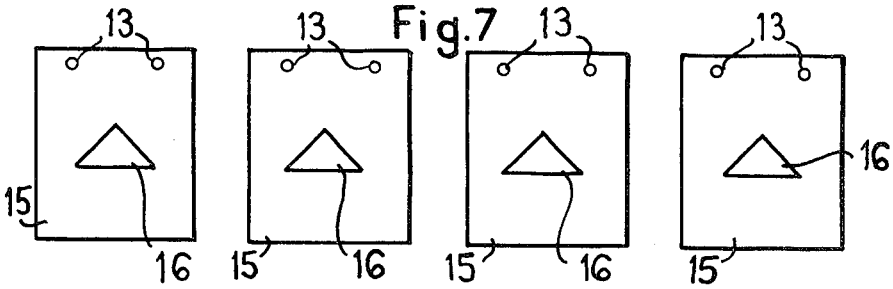

The plates are then processed in the usual manner so as to provide, as shown in FIG. 7, exposed and processed printing plates 15, each with their images 16 in register to the drilled holes 13 in the plates.

Figure 8:
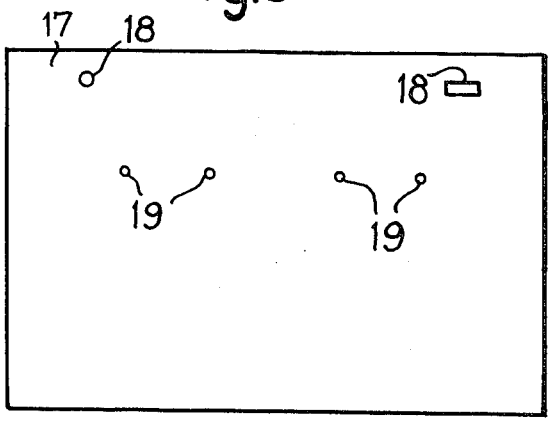

For the purposes of the next stage in the method which is shown in FIG. 8, it should be assumed in the case of four-colour printing that there are two exposed and processed printing plates 15 for each colour, making a total of eight such plates 15 in all. Four large clear films or foil sheets, for example MYLAR are punched together in a foil punch to form register holes 18 in the same position in each sheet 17. Then, using the PROTOCOL REGISTRATOR machine printing plate location holes 19 (two for each plate 15) are drilled with the hollow drill into the sheet 17 with a hole size and centre distance to match the holes 13 so as to obtain a final position for the printing plates 15 relative to the image printing position in the press.

Figure 9:
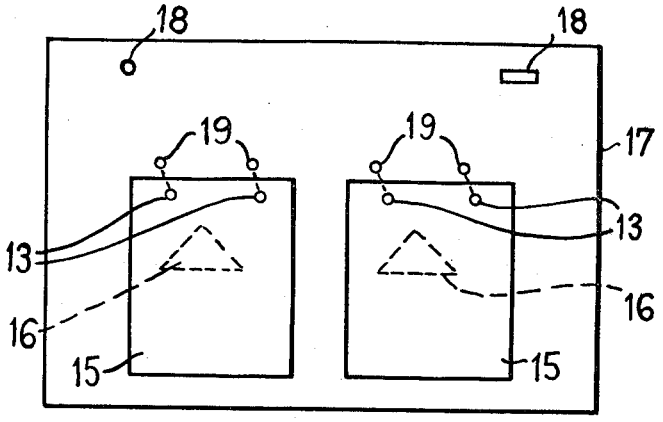

In the next stage of the method, as illustrated in FIG. 9, each of the printing plates 15 has applied to the image side thereof a light coating of a transparent, pressure-sensitive adhesive. Then, each pair of printing plates 15 for a respective one of the colours, is pinned to a respective carrier sheet 17 by passing register pins 14 through the holes 19, in the sheet 17 and 13 in the printing plates 15 with the flat bottoms of the register pins lying against the reverse side of the sheet 17. The plates are positioned image side down and are stuck with the adhesive coating in position and the pins 14 removed. Thus, there are now prepared four sheets 17 each carrying two printing plates 15 in a located in-register position with respect to the register holes 18.

Referring now to FIG. 10, round register holes (not shown) matching the register holes 18 as regards hole width (elongate hole) and hole size (round hole) in the sheet 17, are then drilled in a mounting bar 20 for use in mounting the carrier sheet 17 in the press. Then, round register pins 21 which fit the holes 18 are fitted in the holes in the mounting bar 20. The backs of the printing plates 15 are then coated with a pressure-sensitive adhesive and the carrier sheet 17 is fitted onto the mounting bar 20 by locating the register holes 18 in the sheet over the pins 21 on the mounting bar.

The mounting bar 20 carrying the sheet 17 with printing plates 15 is then fitted to the impression cylinder 22 of a flexo-graphic printing machine 23, as will be apparent from FIG. 11, and the carrier sheet 17 is fed between the impression cylinder 22 and one of the plate cylinders 24 into the position shown in FIG. 11 so that the upper edge of the adhesive backed printing plates 15 lie within the nip 25 between the impression and plate cylinders 22, 24. The plate cylinder 24 is then brought into contact with the printing plates 15 and the plate and impression cylinders are nipped into position. The carrier sheet 17 is released from the mounting bar 20 and the cylinders 22, 24 are rotated in the directions of the illustrated arrows so that the printing plates 15 are stuck in the process to the plate cylinder 24 in an in-register position. The carrier sheet 17 is then stripped off the printing plates 15. This procedure is then repeated for each of the plate cylinders of the press using the remaining carrier sheets each assembled to the mounting bar 20 in turn.

Since the mounting bar can be located in precisely the same position on each impression cylinder 22, and the position of each carrier sheet with regard to the mounting bar is the same for each colour, the positions of the printing plates adhered to the respective plate cylinders can be extremely precise and, therefore, in-register with each other. In an alternative method of mounting the lay bar 20 to the flexo-graphic printing press 23, and shown in dashed lines in FIG. 11, a mounting bar could be fitted to a part of the press frame. Moreover, the lay bar could be mounted on the plate cylinder 24 instead of the impression cylinder 22.

Referring now to FIG. 12, this is a perspective view of a part of a flexo-graphic printing press 23 which includes the nip 25 between one of the plate cylinders 24 and the impression cylinder 22. The impression cylinder 22 is associated with three other plate cylinders in a similar arragement to that shown in the drawing. In an alternative flexo-graphic printing press, each plate cylinder has an associated impression cylinder but this in no way alters the method according to the present invention. FIG. 12 also shows the mounting bar 20 fitted to the impression cylinder 22 and shows a carrier sheet 17 fitted to the register pins 21 on the mounting bar 20 and carrying one printing plate 15. The positions of the impression and plate cylinders 22, 24 is shown after a certain amount of rotation from the position of the carrier sheet in FIG. 11, so that the printing plate 15 is partially adhered to the plate cylinder 24 as well as being adhered to the carrier sheet 17. The impression and plate cylinders are mounted on the press frame 26 and the plate cylinder 24 has an associated inking roller 27 which is not in use during the plate mounting.

The mounting bar 20 comprises a base plate 28 fixed between two side members 29 and to a central reinforced strut 30 which is also fixed to the side members 29. The register holes in which the register pins 21 are fitted are drilled in the base plate 28. Each side member 29 carries a respective V-element (not shown) of which the left-hand as illustrated is adjustable by means of a rotatable screw threaded handle 31. Complimentary V-blocks 32 are fixed to the opposite faces respectively of the impression cylinder 22 and the mounting bar 20 is simply mounted to the impression cylinder by engaging the V-elements on the bar in the recesses in the V-blocks 32, from above, and the handle 31 is turned to secure the mounting bar 20 in an in register position. Since the position of the mounting bar relative to the impression cylinder remains the same for each plate cylinder, the position of the printing plates on the respective plate cylinders 24 is exactly the same. In those presses where each plate cylinder has an associated impression cylinder, the position of the printing plates can still be made the same by precisely adjusting the position of the mounting bar in the succeeding three cylinders to the same position as that for the first cylinder.

In order to ensure that the carrier sheet 17 remains in position on the register pins 21, a series of toggle clamps 33 (FIG. 13) are mounted on the strut 30 of the mounting bar 20.

It will be appreciated that various modifications may be made without departing from the scope of the invention. For example, the form of the mounting bar and its manner of fixing to either the impression cylinder, plate cylinder, or part of the press frame may be in any other suitable manner which will be apparent to those skilled in the art. Moreover, the toggle clamp 33 may be replaced by other forms of suitable clamping means. Where the invention is applied to a mounter-proofer instead of a flexo-graphic printing press, the mounting bar 20 may be fixed in the impression or plate cylinders or a part of the frame of the mounter-proofer.

In the alternative stages shown in FIGS. 14 and 15, the mounting bar 20 is dispensed with and, instead, the carrier sheets 17 are located on pins **21, 21*a* fixed to respective plate cylinders 24 or those equivalent cylinders in a mounter-proofer, at the same locations. Instead of the stage shown in FIG. 9, the backs of the printing plates 15 shown in FIG. 14 are coated with a pressure-sensitive adhesive, register pins 14 are passed through the holes 19 in the carrier sheet 17 and the holes 13 in the plates 15 and the plates 15 are then adhered to the carrier sheet image side up as will be apparent from FIG. 14. As before one carrier sheet 17 will be produced for each colour, and each of the carrier sheets 17 with the printing plates for that colour attached to it will be wrapped around the appropriate plate cylinder 24 and located to it by means of the pins 21*a*, 21 fitted in holes drilled in the plate cylinder and the register holes 18 in the carrier sheet as shown in FIG. 15. In this instance, the trailing end of the carrier sheet 17** will be secured to the plate cylinder or mounter-proofer cylinder by clamping it in an axially extending well (not shown) in the cylinder.

Instead of having several carrier sheets 17, one for each colour, a single carrier sheet may be used. Moreover, the invention is not limited to flexo-graphic printing plates but may also include flexible printing plates which may have a metal foil backing and which are used in letter press printing, for example. In black and white or letter press printing there may be only one carrier sheet 17 with one or more flexible printing plates thereon secured to a printing cylinder or mounter-proofer cylinder. After a printing pass producing the requisite number of prints, another sheet 17 with another printing plate or plates is mounted on the cylinder in the same position.

Another alternative method utilises the stage described with reference to FIG. 9 but dispenses with the need for a mounting bar. Register holes matching the register holes 18 in the carrier sheet 17 are drilled in the printing, e.g. impression cylinders or equivalent mounter-proofer cylinders at the same locations and the carrier sheet 17 with printing plates 15 adhered thereto image-side down as described with reference to FIG. 9 is mounted on the appropriate cylinder by passing register pins through the register holes 18 and fitting the pins into the holes in the cylinder. The printing plates are then secured to the plate cylinder using the method described in FIG. 11 but, of course, without using the mounting bar.

Although the invention has been specifically described with reference to four-colour printing on presses with four plate cylinders, it should be appreciated that the invention is applicable to colour printing with at least two colours and more than four colours with corresponding numbers of plate cylinders.

In the stage shown in FIG. 10, the register pins 21 are round whereas in the stage shown in FIG. 15 one of the register pins 21 is round and the other 21*a* is elongate. It should be appreciated that depending on the particular circumstances one of the register pins 21 in FIG. 10 may alternatively be elongate and the register pins 21*a* in FIG. 15 may alternatively be round. All such pins match the particular registration holes with the elongate pins 21*a* needing only to match the elongate registration holes as regards its width.

I claim:

1. A method of mounting flexible printing plates in at least one of a rotary printing press and mounter-proofer, said method comprising the steps of:

(a) producing a set of exposed films each having an image and two registration holes formed therein at the same set distance from the film image and with the same hole size and centre distance, (b) providing a set of unexposed flexographic printing plates, at least one for each of said films, (c) drilling with a hollow drill two registration holes in the unexposed flexographic printing plates with a hole size and centre distance to match those of the registration holes of said exposed films, (d) passing register pins through the drilled registration holes in said unexposed flexographic printing plates and the registration holes in said exposed films, at least one film for each said unexposed flexographic printing plate, (e) exposing and processing said unexposed flexographic printing plates thereby to produce a set of exposed and processed flexographic printing plates each having its image in register to the said drilled registration holes therein, (f) providing at least one flexible carrier sheet for said exposed and processed flexographic printing plates, (g) forming first registration holes adjacent an edge of said at least one flexible carrier sheet, (h) forming second registration holes having the same hole size and centre distance as the drilled registration holes in said exposed and processed flexographic printing plates, in said at least one carrier sheet whereby said second registration holes in said at least one carrier sheet match said drilled registration holes in said exposed and processed flexographic printing plates and whereby a final position for each of said exposed and processed flexographic printing plates is obtained relative to its image in at least one of the printing press and mounter-proofer, (i) applying pressure-sensitive adhesive to one face of each of said exposed and processed flexographic printing plates, (j) passing register pins through said matching registration holes in at least one of said exposed and processed flexographic printing plates and said at least one carrier sheet thereby to locate said at least one exposed and processed flexographic printing plate on said at least one carrier sheet in an in-register position, (k) securing said at least one exposed and processed flexographic printing plate to said at least one carrier sheet in the in-register position by means of the adhesive, (l) removing the said register pins from the said matching registration holes in said at least one exposed and processed flexographic printing plate and said at least one carrier sheet, (m) locating said at least one exposed and processed flexographic printing plate in an in-register position in at least one of the printing press and mounter-proofer with the aid of said at least one carrier sheet, (n) and locating the remaining ones of said exposed and processed flexographic printing plates in turn in the same in-register position with the aid of said at least one carrier sheet.

2. A method as claimed in claim 1, characterized in that a plurality of said flexible carrier sheets are provided, one carrier sheet for at least one of said exposed and processed flexographic printing plates, in that the said first registration holes are formed in each of said flexible carrier sheets at the same positions adjacent an edge thereof, those ones of said second registration holes to occupy one same position are formed simultaneously in said flexible carrier sheets, and then those ones of said second registration holes to occupy another same position are formed simultaneously in said flexible carrier sheets for each said at least one respective exposed and processed flexographic printing plate, whereby said second registration holes in said flexible carrier sheets match said drilled registration holes in said exposed and processed flexographic printing plates, register pins are passed through the said matching registration holes in each of said flexible carrier sheets and its associated said at least one exposed and processed flexographic printing plate, said exposed and processed flexographic printing plates are adhered to the respective flexible carrier sheets, the register pins are removed from said matching registration holes, and each said flexible carrier sheet with its adhered said at least one exposed and processed flexographic printing plate is positioned in turn in at least one of the printing press and mounter proofer whereby to locate said exposed and processed flexographic printing plates in the same in-register position with the aid of said flexible carrier sheets.

3. A method as claimed in claim 1, characterized in that a single said flexible carrier sheet is provided for all of said exposed and processed flexographic printing plates, at least one of said exposed and processed printing plates is located and adhered to said single flexible carrier sheet in said in-register position thereon, said at least one exposed and processed flexographic printing plate is located in the said in-register position in at least one of the printing press and mounter proofer with the aid of said single flexible carrier sheet and then said single flexible carrier sheet is used to locate any remaining ones of said exposed and processed flexographic printing plates in the same in-register position in at least one of the printing press and mounter proofer.

4. A method as claimed in claim 1, characterized in that said second registration holes in said at least one flexible carrier sheet are also formed by drilling with a hollow drill, thereby obtaining drilled said matching registration holes.

5. A method as claimed in claim 1, characterized in that the adhesive is applied lightly to the image side of said exposed and processed flexographic printing plates and at least one said exposed and processed flexographic printing plate is secured to said at at least one flexible carrier sheet image-side down.

6. A method as claimed in claim 5, characterized in that further registration holes are formed in a mounting bar, which further registration holes match said first registration holes in said at least one flexible carrier sheet, in that register pins matching said first registration holes are fitted in said further registration holes in said mounting bar, and in that said one flexible carrier sheet carrying said at least one exposed processed flexographic printing plate is fitted on the mounting bar by locating said first registration holes therein over said register pins on the mounting bar.

7. A method as claimed in claim 6, characterized in that after location of the said one flexible carrier sheet carrying said at least one exposed and processed flexographic printing plate on said mounting bar, said one flexible carrier sheet is clamped to said mounting bar.

8. A method as claimed in claim 6, characterized in that the assembled mounting bar and said one flexible carrier sheet carrying said at least one exposed and processed flexographic printing plate is layed on at least one of a printing cylinder and a frame part of at least one of the press and mounter-proofer with the axis of said mounting bar in alignment with the cylinder axis, the position of said mounting bar is axially adjusted and said mounting bar is then secured in the adjusted position.

9. A method as claimed in claim 5, characterized in that further registration holes are formed in a printing cylinder of at least one of the rotary printing press and mounter-proofer, which further registration holes match said first registration holes in said at least one flexible carrier sheet and in that said one flexible carrier sheet carrying said at least one exposed and processed flexographic printing plate is mounted on the cylinder by means of registration pins which match said further registration holes in the cylinder and said first registration holes in the said one flexible carrier sheet and which are fitted in the registration holes in the cylinder and located in the first registration holes in said one flexible carrier sheet.

10. A method as claimed in claim 8, characterized in that a pressure-sensitive adhesive is applied to the back side of at least one said exposed and processed flexographic printing plate adhered image-side down to said one flexible carrier sheet.

11. A method as claimed in claim 9, characterized in that a pressure-sensitive adhesive is applied to the back side of at least one said exposed and processed flexographic printing plate adhered image-side down to said one flexible carrier sheet.

12. A method as claimed in claim 11, characterized by the further step of positioning said one flexible carrier sheet carrying said at least one adhesive-backed exposed and processed flexographic printing plate and mounted to said mounting bar between the said printing cylinder and an associated printing cylinder whereby the upper edge of said at least one adhesive-backed exposed and processed flexographic printing plate lies within the nip between said cylinders, in that the associated cylinder is brought into contact with said at least one adhesive-backed exposed and processed flexographic printing plate, the cylinders are nipped into position, the said one flexible carrier sheet is released from said mounting bar and in that the cylinders are rotated whereby in the process said at least one adhesive-backed exposed and processed flexographic printing plate is stuck image side up to the associated cylinder in an in-register position.

13. A method as claimed in claim 12, characterized in that said one flexible carrier sheet mounted on the printing cylinder is positioned between this cylinder and an associated printing cylinder so that the upper edge of said at least one adhesive-backed exposed and processed flexographic printing plate lies within the nip between said cylinders, in that the associated cylinder is brought into contact with said at least one adhesive-backed exposed and processed flexographic printing plate, the cylinders are nipped into position, the said one flexible carrier sheet is released from the register pins in the first mentioned cylinder and in that the cylinders are rotated whereby in the process said at least one adhesive-backed exposed and processed flexographic printing plate is stuck image side up to the associated cylinder in an in-register position.

14. A method as claimed in claim 4, characterised in that the adhesive is applied to the back sides of said exposed and processed flexographic printing plates, in that said adhesive-backed exposed and processed flexographic printing plates are adhered to respective ones of said flexible carrier sheets image-side up, at least one said adhesive-backed exposed and processed flexographic printing plate to each said flexible carrier sheet, in that further registration holes matching said first registration holes in said flexible carrier sheets are formed in at least one of a series of printing press plate cylinders, and equivalent mounter-proofer cylinders, matching register pins are fitted in said further registration holes and in that each said flexible carrier sheet carrying its said at least one adhesive-backed exposed and processed flexographic printing plate is wrapped in turn around the particular cylinder and located to it by means of said matching register pins passing through said first registration holes.

15. A method as claimed in claim 14, characterized in that each said flexible carrier sheet carrying its said at least one adhesive-backed exposed and processed flexographic printing plate has leading and trailing ends of which the leading end is formed with said first registration holes and in that the trailing end of each said flexible carrier sheet carrying its said at least one adhesive-backed exposed and processed flexographic printing plate is clamped to the particular cylinder in an axially extending well therein.

16. A modification of the method as claimed in claim 1, characterised in that said at least one flexible carrier sheet is constituted by the endless flexible plastics belt of a belt rotary printing press, in that the adhesive is applied to the back sides of the printing plates which are located on and secured in said in-register positions to said endless flexible plastics belt, image side up.

* * * * *